United States Patent [19]

Rinde et al.

[11] 4,144,514

[45] Mar. 13, 1979

[54] LINEAR MOTION, ELECTROMAGNETIC FORCE MOTOR

[75] Inventors: John E. Rinde, Endicott; Richard M. Perry, Johnson City, both of N.Y.

[73] Assignee: General Electric Company, Utica, N.Y.

[21] Appl. No.: 738,207

[22] Filed: Nov. 3, 1976

[51] Int. Cl.[2] ..... H01F 7/08

[52] U.S. Cl. ..... 335/229; 335/268

[58] Field of Search ..... 335/79, 80, 81, 229, 335/230, 234, 266, 268, 274

[56] References Cited

U.S. PATENT DOCUMENTS

| | | | |
|---|---|---|---|
| 3,381,181 | 4/1968 | Weathers | 335/230 X |
| 3,460,081 | 8/1969 | Tillman | 335/234 |
| 3,665,353 | 5/1972 | Campbell | 335/274 X |

FOREIGN PATENT DOCUMENTS

| | | | |
|---|---|---|---|
| 1414815 | 10/1968 | Fed. Rep. of Germany | 335/230 |

*Primary Examiner*—George Harris

[57] ABSTRACT

An electromagnetic motor is provided with a samarium cobalt permanent magnet comprising a plurality of radially abutting segments. A combination of linear and non-linear springs with a force gradient larger than the magnetic force gradient facilitate motor operation in proportion to currents in electrical coils positioned on each side of the permanent magnet. Servoamplifiers independently control the current in each electrical coil in response to an input command signal, a motor position feedback signal and an actuator position feedback signal. A failure detection circuit detects coil failure by comparing current in each coil on one side of the magnet with the current in a corresponding coil on the opposite side of the permanent magnet. The circuit produces output signals to disconnect a defective coil and initiate an alarm. The circuit also detects power supply and motor position transducer failures by comparing their respective output voltage signals against predetermined reference voltages. The servoamplifiers and electrical coils are provided in a redundant arrangement and designed with sufficient current capacity to continue motor operation despite a coil failure.

4 Claims, 8 Drawing Figures

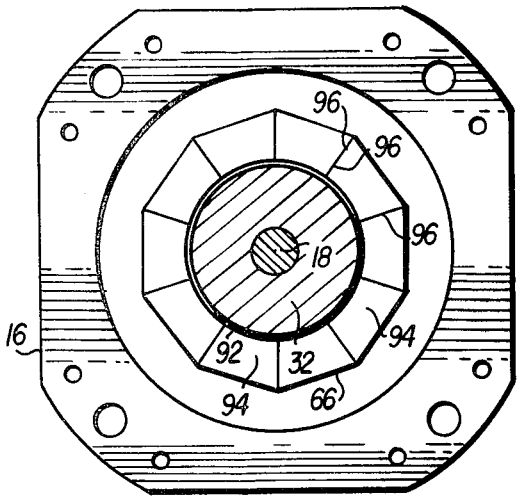
FIG. 2
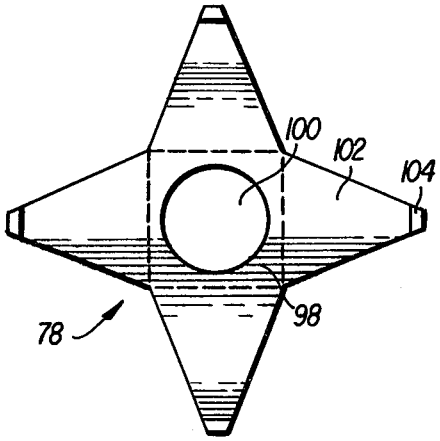
FIG. 3
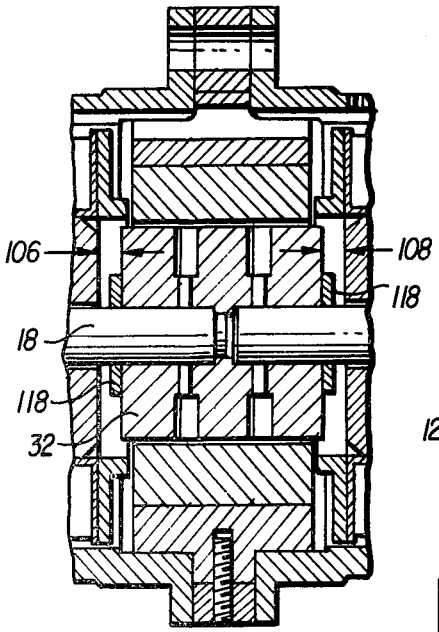
FIG. 6
FIG. 5
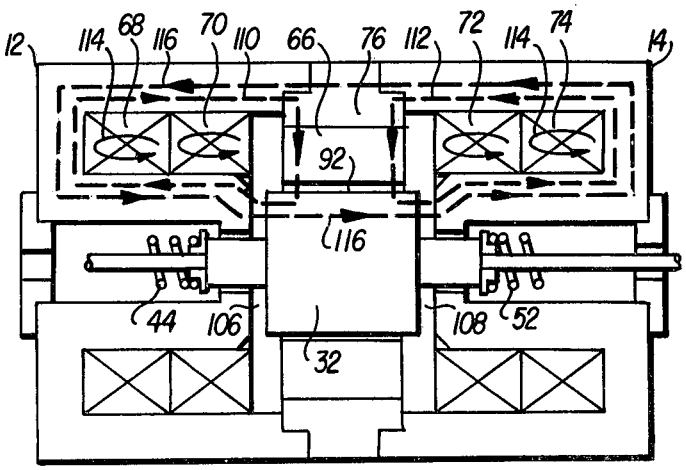

LINEAR MOTION, ELECTROMAGNETIC FORCE MOTOR

BACKGROUND OF THE INVENTION

1. Field of the Invention

This invention relates to electromagnetic motors and more particularly to linear motors employing a permanent magnet and electrical coils to produce a linear movement in either of two opposite directions.

2. Description of the Prior Art

One form of a linear motor is disclosed by Cartwright in U.S. Pat. No. 3,755,699. To produce movement, an electrical coil mounted on an armature which is supported by a non-magnetic shaft is energized to establish a polarity on end cheeks of the armature. The armature then moves between magnetic poles established by permanent magnets. Two diaphragms mounted on each end of the motor housing provide support for the armature and the non-magnetic shaft and also provide a restoring force to return the armature to a center position between oppositely polarized pole pieces when no current is flowing in the coil.

Another linear motor arrangement, employed for controlling a valve, is disclosed by Benson in U.S. Pat. No. 3,772,540. It includes a linearly movable shaft having an armature mounted thereon. A magnetic member is mounted around the periphery of the movable armature and a circular permanent magnet is mounted around the periphery of the magnetic member. Two coils are mounted in the housing with one coil on each side of the permanent magnet. The coils are employed to switch the armature back and forth between its two operating positions. The armature is switched from a first position to a second position by energizing one coil for generating a flux to nullify the permanent magnet flux holding the armature in the first position and by energizing the opposite coil for generating a flux which adds to the permanent flux flowing in the direction of the second position. The armature is then latched into the second position by the permanent magnet flux and the electrical coils are de-energized. A sleeve spring arrangement mounted on the shaft is designed with sufficient resiliency to assure valve closure and has sufficient stiffness to resist bounce-back of the valve or shaft.

These prior art structures have encountered a problem of generating a useful magnetic field of sufficient magnitude to produce an adequate force output while retaining a compact motor structure. Cartwright's separate magnet and pole piece arrangement contributes to flux leakage; thus, the useful magnetic field, and thereby the efficiency of the motor, is decreased. Benson's use of a magnetic conducting material between the circular permanent magnet and the armature increases flux leakage and his disclosed circular permanent magnet structure precludes use of samarium cobalt.

These prior art structures also have encountered problems with detecting a defective coil and with complete motor failure once a coil becomes defective. Cartwright employs only a single electrical coil; thus, coil failure renders his device inoperative. Benson employs two coils connected in series; thus, a coil failure also renders his device inoperative.

The present invention solves these problems by providing a compact motor structure designed to obtain maximum efficiency, by providing a segmented samarium cobalt permanent magnet structure mounted directly adjacent a moving armature, by providing a redundant electrical coil arrangement with each coil independently controlled, and by providing a monitoring circuit for detecting and isolating a defective coil and for providing an alarm upon occurrence of such a defect. The object of this invention is to solve the aforementioned and other problems encountered by the prior art and thus, develop a highly efficient compact linear motor with high performance capability.

One of the objects of this invention is to provide an electromagnetic motor structure with a higher magnetic field concentration than previous structures of comparable size and a structural arrangement to provide maximum utilization of this higher magnetic field.

Another object is to provide an electromagnetic motor with an output movement continuously controlled in proportion to an input electrical signal.

Another object is to provide an electromagnetic motor with a means to prevent latching of the motor.

A further object is to provide an electromagnetic motor with an electrical coil control arrangement capable of detecting and isolating a defective coil and providing an alarm upon occurrence of such defect and capable of continuing motor operation despite a coil failure.

SUMMARY OF THE INVENTION

In carrying out this invention, in one form thereof, an electromagnetic motor for producing linear movement in either of two opposite directions is disclosed. A non-magnetic shaft with an armature mounted thereon is mounted in a motor housing. The armature and shaft are moved by an electromagnetic field developed by a permanent magnet and a plurality of electrical coils mounted in the housing. The permanent magnet is made of samarium cobalt and comprises radial segments arranged with the radial surfaces of each segment abutting a radial surface of each adjacent segment.

A combination of linear and non-linear springs with a combined force gradient larger than the magnetic force gradient is employed to obtain an output movement via the motor non-magnetic shaft which is proportional to current supplied to the coils. The combination of linear springs and non-linear springs also prevent motor latching.

A plurality of electrical coils are employed with at least one coil being mounted on either side of the permanent magnet. Servoamplifiers independently control the current in each coil in response to an input command signal, a motor position feedback signal and an actuator position feedback signal. A failure detection circuit detects coil failure by comparing the current in each coil on one side of the magnet with the current in a corresponding coil mounted on the opposite side of the magnet. The circuit produces output signals to disconnect the defective coil and initiate an alarm. The circuit also detects power supply and motor position transducer failure by comparing their respective output voltage signals against predetermined reference voltages. The motor is enabled to continue operation despite a coil failure by providing a redundant coil arrangement, that is at least two coils on each side of the permanent magnet, and by providing each coil and servoamplifier with sufficient current capacity.

BRIEF DESCRIPTION OF DRAWINGS

FIG. 2 is a sectional view of FIG. 1 illustrating the segmented permanent magnet.

FIG. 3 is a view of a non-linear cantilever spring employed in the motor of this invention.

FIG. 5 is a schematic presentation illustrating flux patterns developed within the motor of FIG. 1.

FIG. 6 illustrates an alternate embodiment of FIG. 1 employing stops.

DESCRIPTION OF THE PREFERRED EMBODIMENT

Figure 1:
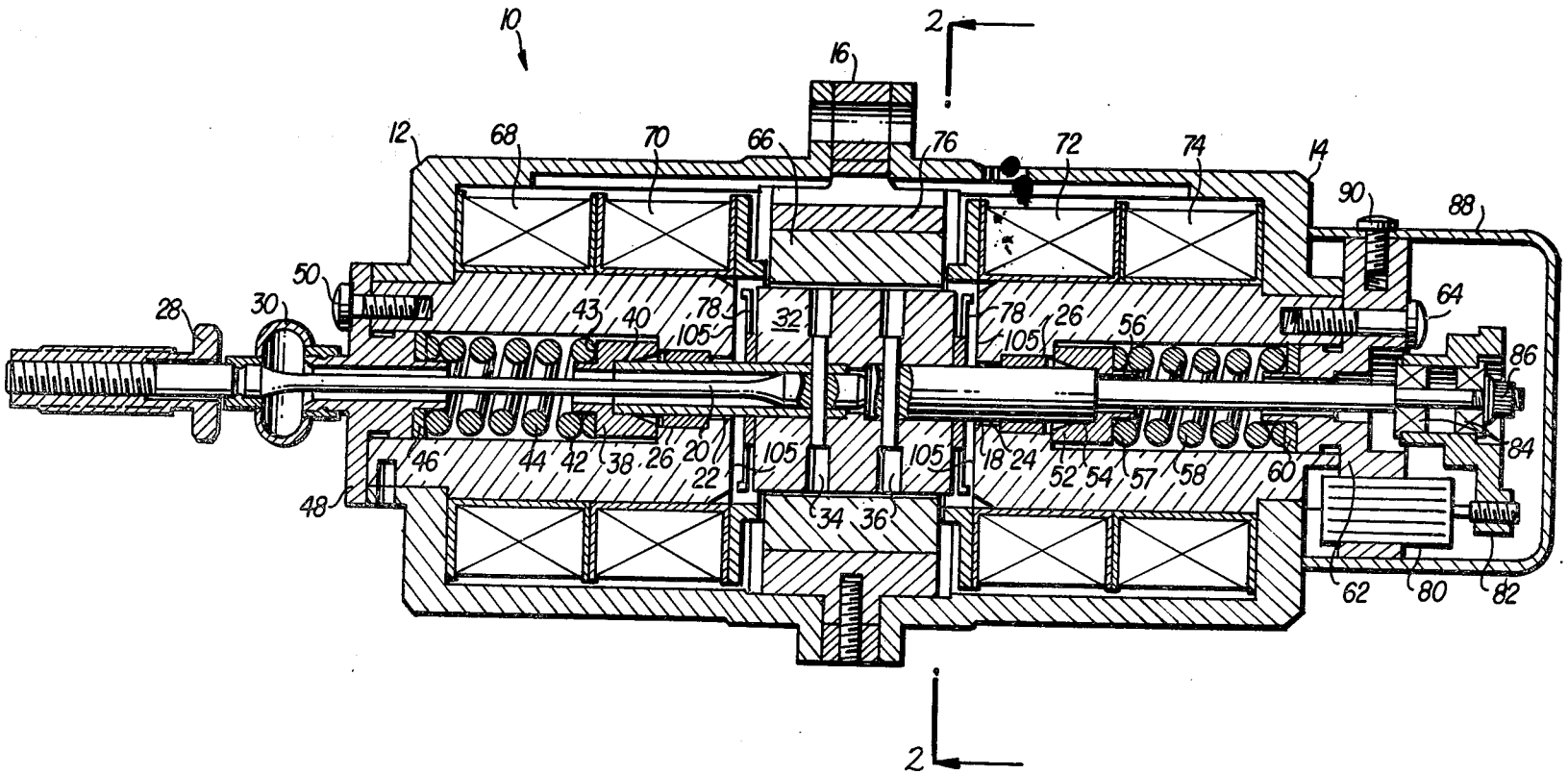
FIG. 1 illustrates the basic structural configuration of the electromagnetic motor.

As shown in FIG. 1, an electromagnetic motor 10 includes two substantially symmetrical end housing sections 12 and 14 joined to the silicon iron magnetic subassembly 16. A non-magnetic shaft 18 comprising shaft sections 20, 22 and 24 is slidably mounted within and supported by two bearings 26, one mounted within each housing section. Shaft section 20 is a quill shaft and is mounted within shaft section 22. The quill shaft extends through housing section 12 with the end thereof external to the housing being employed for connecting the motor to an external device. A screw adjusting device 28 is mounted on the end of the quill shaft to implement such connection. Dirt, water and other foreign particles are prevented from entering housing section 12 by a rubber boot 30 connected between the quill shaft and the housing section.

An armature 32 formed of electromagnetically conducting material, is supported by non-magnetic shaft 18 at approximately the center of housing 10. Two pins 34 and 36 extend radially through the armature to provide a rigid connection between the armature and the non-magnetic shaft 18 and also to join the three shaft sections 20, 22 and 24 into an integral structure to form non-magnetic shaft 18. Pin 34 extends radially through the armature, through the shaft section 22 and through the quill shaft 20 to form a rigid connection. Pin 36 extends radially through the armature and shaft section 24 to also form a rigid connection.

In order to maintain the armature and non-magnetic shaft in a normally centered position within the motor housing 10, a spring arrangement is employed on each side of the armature within housing sections 12 and 14. Within housing section 12 this spring arrangement includes a spring cup 38 with one end thereof having a recess 40 for accepting the end of shaft section 22. The other end thereof has a portion of reduced diameter 42 and a shouldered portion 43 for accepting a helical compression spring 44. The other end of the compression spring bears against shims 46. The spring cup, compression spring and the shims are retained in position by an end cap 48 attached to housing section 12 by an attaching screw 50.

A similar spring arrangement is employed within housing 14. A second spring cup 52 is provided with one end thereof having a recess 54 for accepting shaft section 24, the other end thereof has a portion of reduced diameter 56 and a shouldered portion 57 for accepting a second helical compression spring 58. The other end of the second compression spring bears against a second group of shims 60. The second spring cup, the second compression spring and the second shims are held in position by a second end cap 62 which is attached to motor end housing 14 by an attaching screw 64.

As mentioned previously, the purpose of the compression spring arrangement on each side of the armature is to assure that the armature is maintained in a normally centered position. Attaching screws 50, 64 provide support for each spring arrangement. The shims 46, 60 provide adjustment of the compression of helical springs 44 and 58, respectively, thereby providing a centering adjustment for the armature.

The armature and non-magnetic shaft are moved within the motor housing by an electromagnetic field developed by a permanent magnet 66 and four electrical coils 68, 70, 72 and 74. In order to increase the force output and travel distance of the motor while still retaining its compact structure, the permanent magnet is formed of samarium cobalt. Samarium cobalt can produce a flux with a much higher magnetomotive force than conventional magnets. This higher magnetomotive force also enables the motor to operate with larger air gaps thus producing a travel distance greater than that which would be attainable with a conventional magnet. An additional advantage of samarium cobalt is that it requires a higher demagnetizing force than other magnetic materials thus reducing the possibility of accidental demagnetization. The magnet comprises a part of magnetic subassembly 16 and is mounted around the periphery of movable armature 32. The magnet is formed with radial inward polarization toward the movable armature. By mounting the permanent magnet directly adjacent the moving armature flux leakage is minimized in that the only leakage around the magnet is from the inner diameter edge of the magnet to the other housing. In order to create a flux path between permanent magnet and the outer housing sections 12 and 14, the remaining portion 76 of magnetic subassembly 16 is formed of silicon iron and is mounted around the periphery of the permanent magnet.

A multiple or redundant coil arrangement, that is, two coils on each side of the permanent magnet is provided in order to produce movement of the armature and non-magnetic shaft and to enable continued motor operation despite a failure in one of the electrical coils. In fact, the motor is capable of operating even if only one electrical coil is operable; however, in such circumstances the motor is capable of exerting a lesser maximum force and of handling a lesser load than if two or more coils are operable. Electrical coils 68 and 70 are fixedly mounted within housing section 12 on one side of the permanent magnet and electrical coils 72 and 74 are fixedly mounted within housing section 14 on the opposite side of the permanent magnet. Each coil is designed with sufficient current capacity to enable continued motor operation despite a failure in one or more of the coils when appropriate circuitry is provided as will be discussed later.

Figure 7:
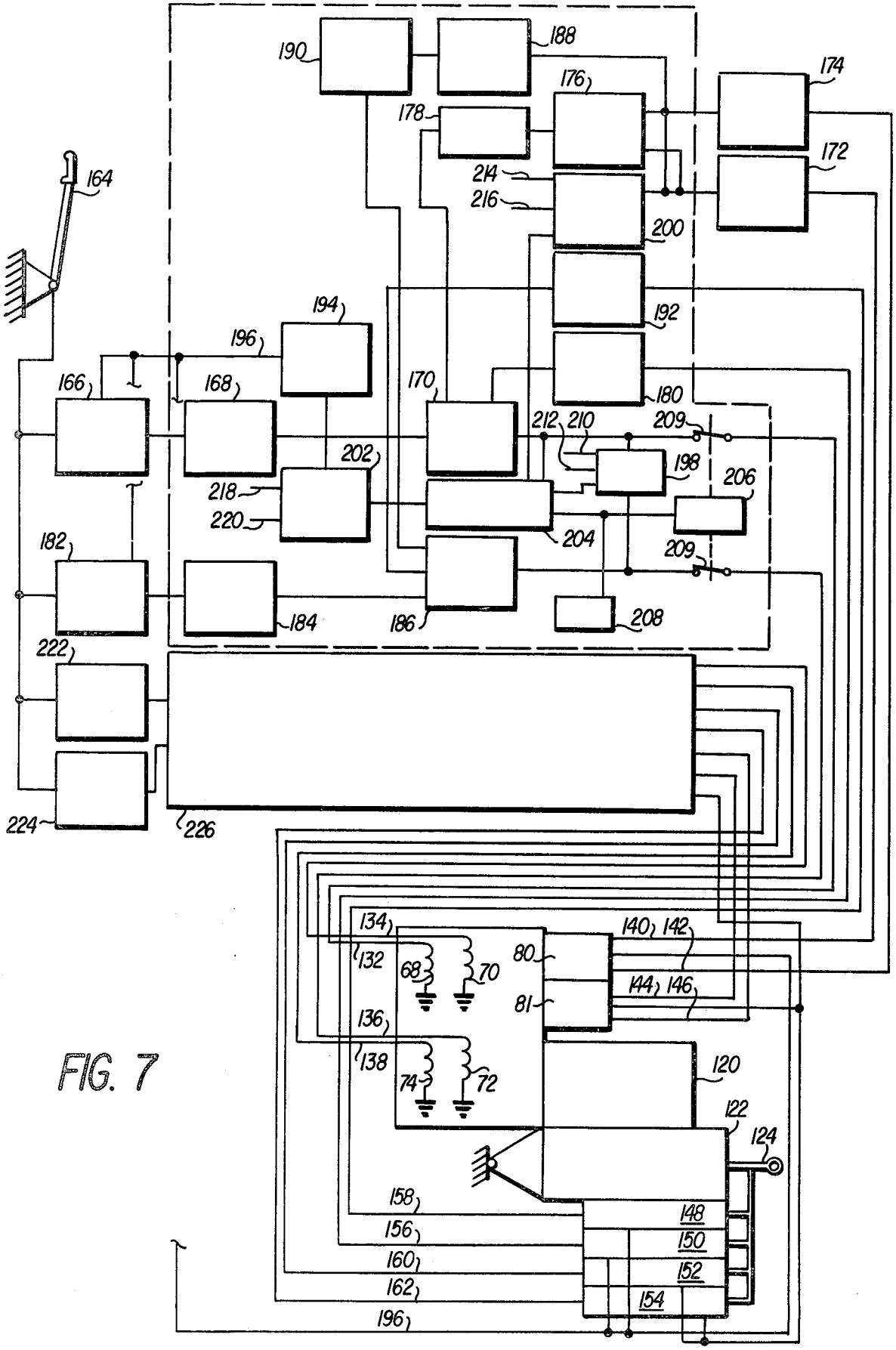
FIG. 7 illustrates a control arrangement for the electromagnetic motor of FIG. 1.

In order to sense the position of the non-magnetic shaft, motor position transducers 80, 81 are provided (81 is not shown in FIG. 1 but shown schematically in FIG. 7). Transducer 80 is mounted to end cap 62 and engages an arm 82. The arm is mounted upon the end of shaft section 24 and moves therewith. Bearings 84 and a nut 86 are employed to attach the arm to the end of the shaft section. In order to prevent damage to the transducers and also prevent foreign particles from entering the motor, an aluminum cover 88 is provided to surround the transducer assembly and is fixed to end cap 62 by means of a screw 90. Transducer 81 mounted symmetrically opposite transducer 80 is actuated by the above-described arm 82 and is shown schematically in FIG. 7.

As best shown in FIG. 2, the permanent magnet 66 is mounted around the outer periphery of armature 32 with a radial air gap 92 located between the permanent magnet and the armature. The permanent magnet is formed of samarium cobalt and comprises a plurality of segments 94 formed in a substantially circular arrangement. As mentioned previously, samarium cobalt is utilized to generate a higher magnetomotive force than could be generated with a conventional permanent magnet. Thus, the motor generates a high force output while still retaining its compact structure. In addition, the higher magnetomotive force allows use of larger air gaps which are employed to produce greater motor travel distance. To produce maximum magnetomotive force and to minimize the flux leakage each samarium cobalt segment having two radial surfaces 96 is mounted directly adjacent to another samarium cobalt segment also having radial surfaces 96 such that each radial surface of each segment abuts a radial surface of the adjacent segment.

The displacement of the non-magnetic shaft and armature of the electromagnetic motor is proportional to the currents supplied to the electrical coils. In order to achieve this proportional relationship, the compression springs 44, 58 and the cantilever springs 78 both illustrated in FIG. 1 are designed to produce a combined spring force for opposing armature displacement which is greater than the positive magnetic force and which increases linearly with respect to the positive magnetic force within the motor. The positive magnetic force increases non-linearly as the armature approaches a maximum displacement from the center position. The compression springs have a linear force versus displacement characteristic. Thus, they cannot, by themselves, compensate for the non-linear increase in the positive magnetic force resulting as the armature approaches maximum displacement. However, the cantilever springs having a non-linear force versus displacement characteristic are mounted as shown in FIG. 1 to oppose armature movement as the armature approaches maximum displacement thus combining with the compression springs to compensate for the non-linear increase in magnetic force. Thus, a proportional relationship between the armature displacement and the current supplied to the electrical coils is created.

The structural configuration of cantilever spring 78 is shown in FIG. 3. The cantilver spring comprises a mounting plate 98 with an opening 100 for accepting non-magnetic shaft 18. Four leaf springs 102 are mounted 90° apart upon the mounting plate. Each leaf spring has a tip or projection 104 on its end opposite the mounting plate for engaging motor housing surfaces 105 shown in FIG. 1.

Figure 4:
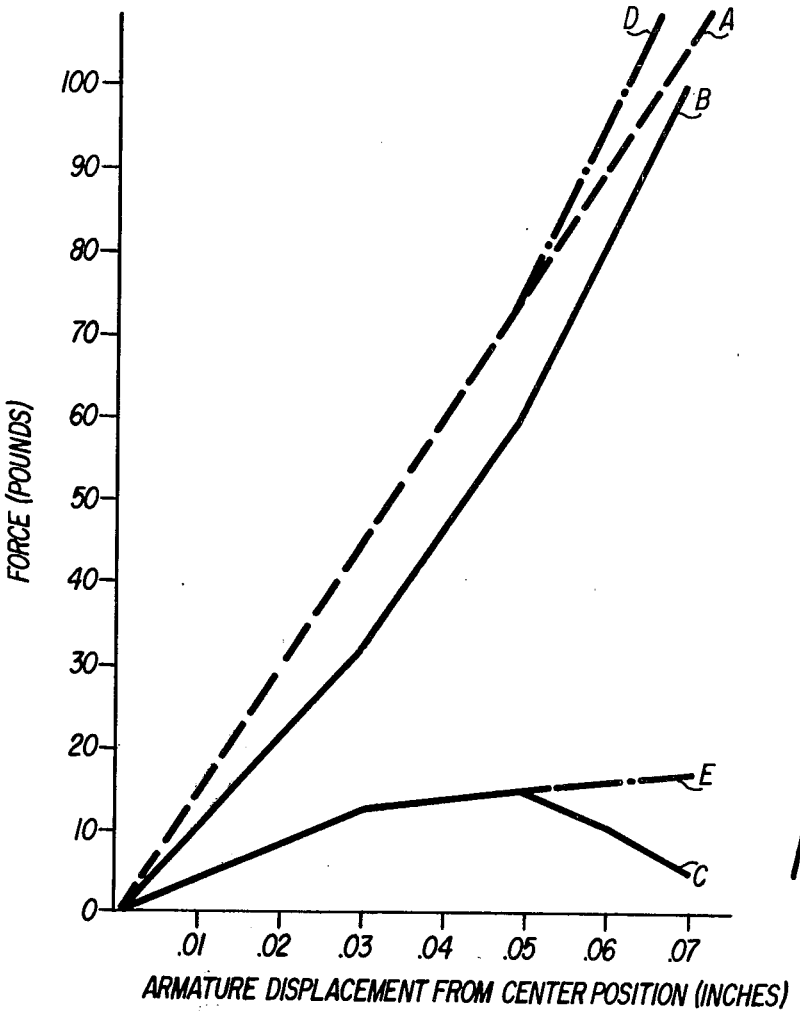
FIG. 4 illustrates the relationships of positive magnetic force and spring forces within the motor.

The effect of employing both the linear compression springs and the non-linear cantilver springs in order to produce armature displacement in proportion to the currents in the electrical coils is best illustrated in FIG. 4. Curve A represents the force of the linear compression springs which in this case were springs of 1500 pounds per inch opposing armature displacement. Curve B represents the positive magnetic force developed in the motor in relation to armature displacement. Note the non-linear increase in positive magnetic force as a maximum of 0.07 inch armature displacement is approached. Curve C represents the difference between the compression springs force, curve A, and the positive magnetic force, curve B. In other words, curve C represents the net force acting to the center the armature within the motor. As can be seen from curve C, the net force for centering the armature decreases as the armature approaches maximum displacement. Thus, armature movement would not be proportional to the current supplied to the electrical coils. Non-linear cantilever springs are employed to compensate for this decrease in net centering force. Curve D represents the combined force achieved by employing both the linear compression springs and the non-linear cantilever springs. Curve E represents the net centering force for the difference between curve D and curve B. As can be seen from curve E, the net centering force increases in a linear relationship as the armature approaches maximum displacement. Thus, movement of the armature will be proportional to the current supplied to the electrical coils.

The operation of the electromagnetic motor can best be described by referring to the schematic presentation in FIG. 5. With no current flowing in the electrical coils from 68, 70, 72, 74, the armature is maintained at a center position, as shown, by the compression springs 44 and 52. In other words, the axial air gaps 106 and 108 are equal with axial air gap 106 being the distance between one side of the armature and housing section 12 and axial air gap 108 being the distance between the opposite side of the armature and housing section 14. The permanent magnet 66 generates a flux flow within the motor depicted by flux lines 110 and 112. Flux line 110 flows from the magnet across the radial air gap 92, through the armature, across axial air gap 106 and returns to the magnet through housing section 12 and portion 76 formed of silicon iron material. Flux line 112 flows from the magnet, across radial air gap 92, through the armature across axial air gap 108 and returns to the magnet through housing section 14 and portion 76 which is formed of silicon iron material. Flux lines 110 and 112 are equal when the axial air gaps 106 and 108 are of equal size. Movement of the armature is accomplished by applying currents to the electrical coils. In order to move the armature to the right, the currents are applied to the electrical coils in the direction indicated by arrows 114. The currents produce an additive flux flow depicted by flux line 116. Flux line 116 flows in a closed path across axial air gap 106, through armature 66, across axial air gap 108, through housing section 14, across portion 76 formed of silicon iron material and through housing section 12. The net flux flow across axial air gap 106 is decreased by flux 116 flowing opposite the permanent magnetic flux 110. However, the net flux flow at axial air gap 108 is increased because magnetic flux 112 and the coil produced flux 116 are flowing in the same direction. Thus, a net force to the right is produced for moving the armature. The distance of this movement is proportional to the current supplied to the electrical coils due to the combined spring forces exerted by compression springs 44, 52 and cantilver springs 78 as discussed previously, with reference to FIG. 4. As the armature moves to the right axial air gap 108 decreases causing a diverting of a portion of the permanent magnet flux flowing in line 110 into the flux line 112. However, the force produced by this diverted flux is offset proportionately by the increase in the combined spring force exerted by the compression springs and the cantilever springs. Therefore, the movement of the armature is proportional to the current applied to the electrical coils.

FIG. 6 illustrates an alternate embodiment of the electromagnetic motor. In this embodiment, stops 118 are employed to limit the movement of the armature 32 and non-magnetic shaft 18 rather than the cantilever springs 78 shown in FIG. 1. The stops are formed of a non-magnetic material with a thickness approximately one-half the air gaps 106, 108 when the armature is centered and are attached to each side of the armature.

As mentioned previously, the electromagnetic motor is designed to produce movement in proportion to the current supplied to the electrical coils and is provided with a multiple or redundant coil arrangement to enable continued motor operation despite coil failure. In order to utilize these design features, a control and monitoring arrangement is employed with the motor as illustrated in FIG. 7. In this arrangement, the electromagnetic motor 10 is connected to operate a control valve 120 and the control valve is in turn connected to operate a power actuator 122. The power actuator has an output shaft 124 for connection to an external device being controlled.

Figure 8:
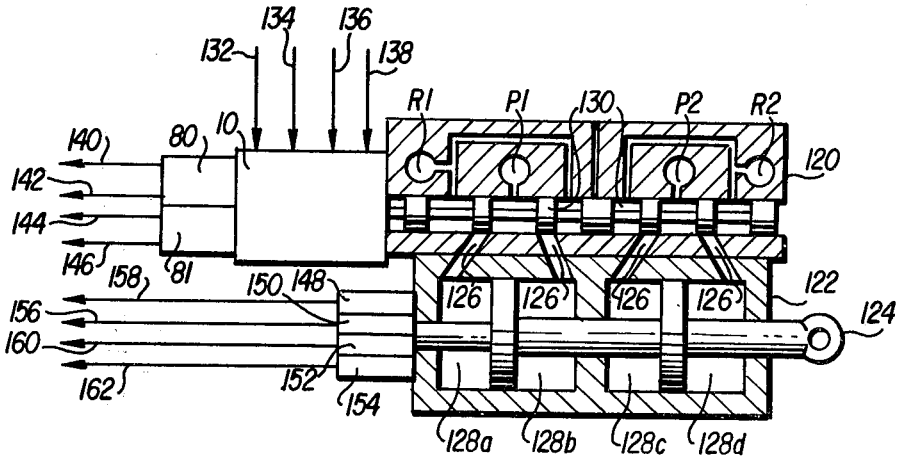
FIG. 8 illustrates connection details of the electromagnetic motor, control valve and power actuator.

The motor, control valve and power actuator are shown only schematically in FIG. 7. The actual physical relationship and interconnection of the motor, the control valve and the actuator are best illustrated in FIG. 8. The control valve is a dual tandem unit which is employed to supply hydraulic fluid to the power actuator for positioning the actuator output shaft. The control valve is provided with two hydraulic input ports P1, P2, two hydraulic return ports R1 and R2, and four hydraulic output ports 126 which feed four chambers 128*a*, 128*b*, 128*c*, 128*d* within the power actuator. The flow of hydraulic fluid from the control valve to the power actuator chambers is controlled by two spools 130 slidably mounted within the valve and connected for simultaneous movement. The position of the spools determines the pressure supplied to the actuator chambers which in turn sets the position of the actuator output shaft. For example, in order to move the actuator output shaft to the right, the electromagnetic motor 10 moves the spools to the left, thus causing hydraulic fluid flow from valve ports P1 and P2 into actuator chambers 128*a* and 128*c*. By their initial movement the spools also create a flow connection from hydraulic chambers 128*b*, 128*d* to return ports R1, R2, respectively, causing a decrease in pressure in these chambers. Therefore, a net force is produced for moving the power actuator output shaft to the right.

Again referring to FIG. 7, movement of the electromagnetic motor is caused by currents fed to the motor electrical coils 68, 70, 72, 74 from input lines 132, 134, 136, 138, respectively. In order to sense the position of the motor, two motor position sensing transducers 80, 81 are provided with transducer 80 producing two identical output signals over lines 140 and 142. These output signals are also identical to two output signals produced by transducer 81 and transmitted over lines 144 and 146. In order to sense the position of the power actuator, four actuator position transducers 148, 150, 152, 154 are provided for producing identical output signals over lines 158, 156, 160, 162, respectively.

The above-described arrangement provides four separate signals representative of motor position and four separate signals representative of actuator position which are utilized to provide a redundant control to enable continued motor operation despite coil failures. In the redundant control arrangement, the current in each coil on one side of the permanent magnet is compared against the current in a corresponding coil on the opposite side of the magnet. This current comparison detects a defective coil and is employed to disconnect the defective coil and the corresponding coil on the opposite side of the magnet. Despite disconnection of two of the coils, the motor continues operation on the remaining pair of coils. This continued motor operation is possible because each coil is provided with a separate servoamplifier and each servoamplifier has sufficient current capacity to operate the motor.

The control for one pair of coils (comprising an electrical coil on one side of the magnet and its corresponding coil on the opposite side of the magnet) is identical to the control for the remaining pair of coils. Therefore, while the control for coil 68 and 72 will be described it will be understood that the control for the other two coils 70 and 74 is identical. In addition, while the control arrangement for coil 68 will be described first, it is understood that coil 72 whose control arrangement will be described later, is energized simultaneously with coil 68. The control arrangement for supplying current to the electrical coil 68 includes a position control lever 164 connected to a control lever position transducer 166. A demodulating, shaping and filtering element 168 is connected to the output of the transducer and its output is connected to a servoamplifier 170. The demodulating, shaping and filtering element includes a buffer amplifier for attenuating noise, a demodulating element for extracting a signal representative of the lever position and a filtering element for filtering the extracted signal. The servoamplifier 170 is connected through the line 132 to coil 68. The control lever is moved in one direction to produce a current of one polarity from the servoamplifier 170 to cause motor movement in one direction and the control lever is moved in the opposite direction to produce a current of opposite polarity from the servoamplifier to cause motor movement in the opposite direction. The energization of coil 68 causes the motor 10 to move the valve 120 which in turn moves power actuator 122.

In order to insure that the electromagnet motor and the power actuator have moved to the correct position a feedback to the servoamplifier is provided. This comprises the motor position transducer 80 connected through lines 140 and 142 to servoamplifier 170 and the power actuator position transducer 150 connected by line 156 to the servoamplifier 170. These feedbacks cause a modification in the control current to coil 68 if necessary to obtain correct position of actuator shaft 124. To reduce noise, buffer amplifiers 172, 174 are provided in lines 140 and 142, respectively, between the transducer 80 and summing amplifier 176. The outputs of the buffer amplifiers are connected, to the summing amplifier 176 which sums the two signals and produces an output to a demodulating element 178. This demodulating element extracts a signal representative of motor position and feeds this representative signal to servoamplifier 170. To reduce noise and to extract a signal representative of actuator position, a buffer and demodulating element 180 is provided in line 156 between transducer 150 and servoamplifier 170. The outputs of 178 and 180 are connected to servoamplifier 170 where they are summed with the input command signal from element 168. If the summation produces no error signal, this indicates that the motor and the power actuator have moved to the correct position, and the servoamplifier does not readjust its output current. However, if an error signal is produced indicating that the actuator output shaft 124 needs further adjustment, then the servoamplifier modifies its currents output to electrical coil 68 in proportion to the error signal in order to obtain the desired position of the shaft.

A similar control arrangement is employed in controlling the current to coil 72 which is disposed on the opposite side of the permanent magnet. This arrangement includes the position control lever 164 connected to a second control lever position sensing transducer 182. A demodulating, shaping and filtering element 184 is connected to the output of the second transducer and its output is connected to a second servoamplifier 186. The demodulating, shaping and filtering element includes a buffer amplifier for attenuating noise, a demodulator element for extracting a signal representative of control level position and a filtering element for filtering the extracted signal. The servoamplifier is connected through the line 136 to coil 72. The control lever is moved in one direction to produce a current of one polarity from the servoamplifier 186 to cause motor movement in one direction and the control lever is moved in the opposite direction to produce a current of opposite polarity from the servoamplifier to cause motor movement in the opposite direction. The energization of coil 72 causes motor 10 to move the valve 120 which in turn moves power actuator 122.

In order to insure that the motor and the power actuator have moved to the correct position feedbacks to the servoamplifier 186 similar to the feedbacks to servoamplifier 170 just described, are provided. This comprises motor position transducer 80 connected through lines 140 and 142 to servoamplifier 186 and actuator position transducer 148 connected by line 158 to servoamplifier 186. These feedbacks cause a modification in the control current to coil 72 if necessary to obtain correct position of actuator shaft 124. As mentioned previously, to reduce noise buffer amplifiers 172, 174 are provided in lines 140 and 142, respectively. The outputs of the buffer amplifiers are connected to summing amplifier 188 in addition to being connected to summing amplifier 176. The summing amplifier 188 sums the two output signals from the buffer amplifiers and produces an output signal to a second demodulating element 190. This demodulating element extracts a signal representative of motor position and feeds this representative signal to servoamplifier 186. To reduce noise and to extract a signal representative of actuator position, a buffer and demodulating element 192 is provided in line 158 between transducer 148 and servoamplifier 186. The outputs of 190 and 192 are connected to the servoamplifier where they are summed with the input command signal from element 184. If the summation produces no error signal, this indicates that the motor and the power actuator have moved to the correct position, and the servoamplifier does not readjust its current output. However, if an error signal is produced indicating that the output shaft 124 needs further adjustment then the servoamplifier modifies its output current to coil 72 in proportion to the error signal in order to obtain the desired position of the shaft.

A common power supply 194 is employed for supplying power to the transducers associated with the controls for coils 68 and 72. The power supply provides a voltage feed on line 196 to control position transducers 166, 182, motor position transducer 80 and power actuator position transducers 148, 150. In addition, the power supply is utilized to develop reference voltages employed within a failure detection circuit as will be discussed later.

As described thus far, the control arrangement for the two coils 68 and 72 by use of their separate servoamplifiers, vary the currents in the coils in order to set the position of the motor 10 and in turn the position of the power actuator 122. Also, the servoamplifiers can check the correctness of the actuator position and the motor position via position transducers and modify the currents to the electrical coils if necessary in order to obtain the correct positions of the motor and actuator. In addition, a failure detection circuit arrangement is provided to detect a failure in either coil 68 or 72, to detect a failure in the common power supply 194 and also to detect a failure in motor position transducer 80. If a failure is detected, coils 68 and 72 are disconnected and an alarm signal is generated.

The failure detection circuit includes a logic element 204 having input connections from a coil current comparator 198, a position transducer self-monitoring circuit 200, and a power supply monitoring element 202. If no failure have occurred, logic element 204 receives continuous input signals from elements 198, 200 and 202 and the logic element in turn supplies a continuous signal to maintain a relay 206 in an energized condition and to maintain an alarm element 208 in an unlatched condition. Relay 206 has two normally open contacts 209 which are held closed when the relay is energized with one contact connected in series between servoamplifier 170 and coil 68 and the other contact connected in series between servoamplifier 186 and coil 72. A failure causes a discontinuation of one of the particular inputs to the logic element. The logic element in turn terminates its output signal to the relay and the alarm element. Thus, the relay is de-energized and its contacts open causing coils 68 and 72 to be disconnected. The termination of the output signal from the logic element also latches the alarm element in the alarm condition.

In detecting a failure of either electrical coil 68 or 72, coil current comparator 198 receives input current signals from the outputs of servoamplifiers 170 and 186 on lines 132 and 134, respectively. The comparator compares these currents which are being supplied to coils 68 and 72 and generates a difference signal between the two currents. The comparator transmits an output signal to logic element 204 provided this difference signal is lower than a reference voltage 210 and higher than a reference voltage 212. However, if the difference between the two currents is outside the limits set by the reference voltages 210, 212 the comparator terminates transmission of its output signal to logic element 204. The logic element in turn terminates its output signal. Thus, relay 206 is de-energized and its contacts 209 opened causing coils 68 and 72 to be disconnected. In addition, the termination of the signal from the logic element also latches the alarm element in the alarm condition.

In detecting failure of motor position transducer 80, transducer self-monitoring circuit 200 receives input signals from the buffer amplifiers 172, 174. The self-monitoring circuit includes a summing amplifier which sums the input signals from the buffer amplifiers. The self-monitoring circuit produces an output signal to logic element 204 provided the summation voltage is lower than reference voltage 214 and higher than reference voltage 216. However, if the summation voltage is outside the limits set by these reference voltages 214, 216 the transducer self-monitoring circuit terminates transmission of its output signal to logic element 204. The logic element in turn terminates its output signal. Thus, relay 206 is de-energized and its contacts 209 are opened causing coils 68 and 72 to be disconnected. In addition, the termination of the signal from the logic element latches the alarm element in the alarm condition.

In detecting failure of common power supply 194, a power supply monitoring element 202 receives an input signal from the power supply. The monitoring element employs the power supply input supply with an inverted transistor pair to supply an output signal to logic element 204 provided both reference voltage 218 and reference voltage 220 are also present at the monitoring element 202. These reference voltages 218, 220 are developed by use of voltage outputs from the common power supply 194. Loss of either of the voltages 218, 220 causes termination of the output signal from the inverted transistor pair to logic element 204. The logic element in turn terminates its output signal. Thus, relay 206 is de-energized and its contacts 209 are opened causing coils 68 and 72 to be disconnected. In addition, the termination of the signal from the logic element also latches the alarm element in the alarm condition.

For simplicity and clarity the above-described control arrangement for the motor coils has been described in terms of the control associated with electrical coils 68 and 72. As mentioned previously, coil 68 is mounted on one side of the permanent magnet 66 and coil 72 is mounted on the opposite side of the permanent magnet. The control associated with coil 70 and coil 74, each located on opposite sides of the permanent magnet from each other, is identical to the control associated with coils 68 and 72. The coils 70, 74 are provided with control level position transducers 222, 224, motor position transducer 81 and actuator position transducers 152, 154. In addition, as represented by 226, the control for the coils 70, 74 includes a duplicate arrangement of servoamplifiers, a second power supply, and failure detection circuit. It can easily be seen from FIG. 7 that these elements are exact counterparts of the corresponding elements whose arrangement and operation have been described in detail in the discussion of coils 68 and 72 above.

The above-described preferred embodiment of this invention utilizes four electrical coils which are controlled in pairs. However, it can readily be seen that alternate embodiments of this invention could be devised employing six coils, eight coils or other multiples of two to gain further redundancy and thus enable motor operation despite multiple coil failures.

In addition, the motor is capable of operating with only one electrical coil being operative although with a lesser maximum force or load capability than if two or more coils remain operative. To utilize this feature, the motor could employ three effective electrical coils in conjunction with an electronic comparator and logic circuit is described in U.S. Pat. No. 3,505,929 with the model element in the aforementioned patent being a model coil element. With this arrangement, the motor would continue to operate despite coil failures as long as even one coil remains operative. Further, it can readily be seen that this arrangement could be implemented with the motor having six electrical coils by connecting each coil on one side of the permanent magnet in series with a corresponding coil on the opposite side of the magnet; thus, the motor would have essentially three effective coils and would be capable of continuing operation despite failure of two or the three effective coils.

Accordingly, it is intended by the appended claims to cover all modifications which come within the spirit and scope of this invention.

What is claimed as new and desired to be secured by Letters Patent of the United States is:

1. An electromagnetic motor for producing a linear movement in either of two opposite directions comprising:

(a) a housing of electromagnetically conducting material;

(b) a non-magnetic shaft mounted in said housing for linear movement in either of two opposite directions;

(c) an annular armature of magnetically conducting material connected to said shaft;

(d) spring means comprising a first spring member and a second spring member, said first spring member being armature on one side of said armaure and said second spring member being mounted on the other side of said armature, each of said spring members have one end engaging said shaft and the other end engaging said housing;

(e) means for limiting movement of said armature in both directions, said means comprising a first member positioned between one side of said armature and said housing and a second member positioned between the opposite side of said armature and said housing;

(f) an annular samarium-cobalt permanent magnet mounted in said housing and extending around the periphery of said armature and forming a radial air gap between said magnet and said armature;

(g) said magnet comprising a plurality of radially abutting segments;

(h) a plurality of electrical coils fixedly mounted in said housing with at least one coil mounted on each side of said permanent magnet; and (i) means for energizing said coils with a first polarity for moving said shaft in one direction and with a second polarity for moving said shaft in an opposite direction.

2. The electromagnetic motor of claim 1, wherein said means mounted to engage said housing for limiting movement of said armature comprises a first spring member positioned between one side of said armature and said housing and a second spring member positioned between the opposite side of said armature and said housing.

3. The electromagnetic motor of claim 1, wherein said means mounted to engage said housing for limiting movement of said armature comprises a first non-magnetically conducting stop member positioned between one side of said armature and said housing and a second non-magnetically conducting stop member positioned between the opposite side of said armature and said housing.

4. An electromagnetic motor for producing linear motion comprising a housing, a non-magnetic output shaft supported within said housing, a movable armature formed of a magnetic material and connected to said output shaft, a permanent magnet mounted in said housing around the periphery of said armature, a plurality of electrical coils mounted in said housing with at least one coil mounted on each side of said permanent magnet, the improvement which comprises said magnet being formed of a plurality of radially abutting segments of samarium-cobalt.

* * * * *